United States Patent [19]

Terekhov et al.

[11] 4,160,665

[45] Jul. 10, 1979

[54] NICKEL-BASE ALLOY

[76] Inventors: Kuzma I. Terekhov, Maly Pionersky pereulok, 5, kv. 44; Alexei T. Tumanov, B. Gruzinskaya ulitsa, 36, kv. 58; Ljudmila S. Markina, ulitsa Krasna Kazanets, 19, korpus 1, kv. 119; Klavdia A. Okolelova, Krasnoprudnava ulitsa, 7/9 kv. 181; Alexandr F. Belov, Leninsky prospekt, 66, kv. 114; Nikolai D. Bobovnikov, Savvinskaya naberezhnaya, 3 kv. 170; Fedor V. Tulyankin, ulitsa Zaporozhskaya, 2, kv. 49; Petr A. Zasetsky, ulitsa 26 Bakinskikh Komissarov, 7, korpus 3, kv. 24, all of Moscow; Vladimir N. Zhuchin, ulitsa Koreshkova, 10 kv. 10; Mikhail Y. Dzugutov, ulitsa Mira, 4, kv. 37, both of Elektrostal; Mikhail S. Podolsky, Profsojuznaya ulitsa, 52 korpus 2, kv. 35, Moscow; Valentin V. Topilin, ulitsa Mira, 6, kv. 29, Elektrostal, all of U.S.S.R.

[21] Appl. No.: 817,531

[22] Filed: Sep. 19, 1977

Related U.S. Application Data

[63] Continuation of Ser. No. 347,492, Apr. 3, 1973, abandoned.

[51] Int. Cl.[2] ..... C22C 19/05

[52] U.S. Cl. ..... 75/171; 148/32.5

[58] Field of Search ..... 75/171, 170; 148/32, 148/32.5

[56] References Cited

U.S. PATENT DOCUMENTS

| | | | |
|---|---|---|---|
| 2,570,193 | 10/1951 | Bieber et al. | 75/171 |
| 2,712,498 | 7/1955 | Gresham et al. | 75/171 |
| 3,304,176 | 2/1967 | Wlodek | 75/171 |
| 3,744,996 | 7/1973 | Shaw et al. | 75/171 |

*Primary Examiner*—R. Dean

*Attorney, Agent, or Firm*—Haseltine, Lake & Waters

[57] ABSTRACT

The alloy of the invention comprising the following components in weight percent:

0.04–0.08 carbon; 13–16 chromium; 2.3–3.0 titanium; 1.8–3.0 aluminum; 2.2–6.0 niobium; 6–12 cobalt; 4–8 molybdenum;

0.001–0.1 lanthanum; 0.001–0.01 boron; 0.001–0.03 cerium and the balance-nickel.

3 Claims, No Drawings

NICKEL-BASE ALLOY

This is a Rule 60 Continuation of U.S. patent application Ser. No. 347,492, filed Apr. 3, 1973, now abandoned.

The present invention relates to non-ferrous metallurgy and more particularly to a high-temperature alloy which may prove useful for the production of disks, baffles, nozzle rings and other heavy-duty components of a turbine hot section in turbojet or turboprop engines operating at high temperatures ranging from 750° to 850° C.; it may be also applicable to other fields of engineering and more specifically to the production of stationary turbines.

As to the order of high-temperature strength, in the most critical for the turbine disks range of working temperatures (650°-800° C.) the alloy proposed herein is by 20-25% superior to serial disk alloys produced in the Soviet Union and to the best alloys developed abroad (e.g. nimonic-105, astroloy, udimet-500) by which virtue the working temperature of the disks can be increased by 50°-100° C. and the weight of the turbine hot section components decreased by 10-12%. Hence, the weight of flying vehicle structures can be materially diminished and their reliability enhanced during continuous service.

Known in the art is a nickel casting alloy (cf. British Patent No. 1029065, C1.C7A) which has the following composition, weight percent:

0.1-0.2 carbon; 4-5.5 chromium; 2-7 titanium; 2-8 aluminum; 8-20 tungsten; 0-6 molybdenum; 5-15 cobalt; 0-3 tantalum; 0.01-0.1 boron; 0.01-0.1 zirconium and the balance-nickel.

However, the composition of the above alloy incorporates high-priced and scarce elements, such as tantalum and tungsten.

Moreover, the use of tungsten, whose contents in the prior-art alloy ranges from 8 to 20% by weight, increases the weight of fabricated parts owing to high specific gravity of this element ($\gamma$ = 19.2 g/cm$^3$). In addition, tungsten contributes to the formation of a coarse heterogeneous liquation structure both in castings and stampings.

Also known is a nickel-base alloy (cf. British Patent No. 1075216, C1.C7A) comprising percent by weight:

0.02-0.1 carbon; 10-17 chromium; 11-16 cobalt; 5-9 molybdenum; 2.53-5.2 aluminum; 0-1.73 titanium; 1-3.5 niobium; 0-2.0 vanadium; 0.001-0.01 boron; 0.01-0.1 cerium and the balance-nickel.

However the alloy given hereinbefore has low mechanical properties: tensile strength — 99-116 kg/mm$^2$; yield strength — 79-104 kg/mm$^2$; elongation 3-12%.

The object of the present invention of to provide a nickel-base alloy which would feature the enhanced high-temperature strength and high mechanical properties being in the meantime reasonably doped with cobalt (6-12%) and whose composition would not incorporate scarce and high-priced elements, such as tungsten and tantalum.

Another important object of the invention is to provide a high-temperature alloy possessing high technological ductility which would make possible the production of disk stampings of intricate shape both on presses and hammers.

The above objects are accomplished by the provision of a nickel-base alloy containing carbon, chromium, titanium, aluminum, niobium; cobalt, molybdenum, boron and cerium, the composition of said alloy, according to the invention, additionally incorporating lanthanum, the weight percentage of the components being:

0.04-0.08 carbon; 13-16 chromium; 2.3-3.0 titanium; 1.8-3.0 aluminum; 2.2-6.0 niobium; 6-12 cobalt; 4-8 molybdenum; 0.001-0.1 lanthanum; 0.001-0.01 boron; 0.001-0.03 cerium and the balance-nickel.

The alloy proposed herein comprises an increased amount of the main alloying elements — aluminum, titanium and niobium that enter the alloy base — a solid solution, a feature which has favoured the enhancement of durability, better mechanical properties and ductility.

Higher aluminum and niobium contents resulted in an increased up to 30-35% amount of the reinforcing intermetallide $\gamma'$-phase and accordingly in a substantial rise in the high-temperature strength.

At the same time a higher concentration of molybdenum and niobium contributed to higher thermal stability of the alloy. In addition, niobium is responsible for a more complicated composition and structure of the main reinforcing intermatallide $\gamma'$-phase — $Ni_3(Al,Ti,Nb)$ instead of $Ni_3(Al,Ti)$.

To solve the above problem it was necessary to increase the thermal stability of not only the intermetallide $\gamma'$-phase but of the alloy solid solution as well. This was attained by increasing the content of not only titanium, aluminum and niobium, but also of chromium and molybdenum and by the introduction into the alloy composition of cobalt amounting to 6-12% by weight; this enhanced the technological ductility of the alloy which is of prime importance in the fabrication of stampings for turbine disks featuring an intricate geometric form and hardly liable to deformation.

A higher chromium content made it possible to stabilize the solid solution and to increase the high-temperature strength of the alloy.

Besides, introduced additionally into the alloy composition are such important and efficient microalloying elements as lanthanum (0.001-0.1% by weight) and cerium (0.001-0.03% by weight).

The use of the microalloying additions — lanthanum and cerium — improve the state of grain boundaries, contribute to the formation of fine-grain homogeneous structure and to improved fracture quality, which has a marked effect on the enhancement of the order of mechanical properties of the herein-proposed alloy.

Thus, the selection of the optimum percentage of the alloy components enabled an increase in both the mechanical properties and high-temperature strength of the alloy retaining its high ductility.

As compared with the known alloys in the same range, the composition of the herein-proposed alloy does not incorporate high-proced and scarce elements, such as tungsten and tantalum, the enhanced technological ductility of the elloy being attained by doping it with reasonable amounts of cobalt (6-12% by weight) and the increased creep resistance — by the introduction of molybdenum and niobium.

The sum of the main alloying elements — titanium, aluminum and niobium forming the reinforcing $\gamma'$-phase is so chosen as to ensure adequate deformability of the alloy.

A well-balanced list of the alloying elements — aluminum, titanium, niobium, molybdenum and chromium-along with the reasonable doping with cobalt and lanthanum assure high mechanical properties and high-temperature strength of the alloy.

The high-temperature strength of the proposed alloy in comparison with that of the known foreign-made nickel-base alloys is given in Table I which follows.

Table 1

| Alloy | Cobalt content, % | Stress, kg/mm² in 100 hr 650° | 700° | 750° | 800° | 850° | 870° |
|---|---|---|---|---|---|---|---|
| Proposed herein | 10 | 85 | 68 | 55 | 40 | 30 | 22 |
| Nimonic-105 (England) | 20 | 79 | 62 | 49 | 38 | 29 | 23 |
| Udimet-500 (USA) | 20 | 77 | 60 | 46 | 32 | 28 | 22 |
| Astrology (USA) | 15 | 79 | 62 | 49 | 38 | 29 | — |

Illustrative examples of the embodiment of the present invention are given hereinbelow.

EXAMPLE NO. 1

A nickel-base alloy of the following composition (in weight percent) was taken: 0.05 carbon; 13 chromium; 2.3 titanium; 2.3 aluminum; 2.5 niobium; 8 cobalt; 4 — molybdenum; 0.01 — lanthanum; 0.001 boron; 0.001 cerium and the balance-nickel.

The above alloy was subject to heat treatment which consisted of hardening at a temperature of 1150° C. for 8 hours and subsequent cooling in air. This was followed by the second hardening at a temperature of 1050° C. for 4 hours after which the alloy was cooled in air. Then the alloy was subject to ageing at a temperature of 850° C. for 8 hours with subsequent cooling in air. After that the second ageing operation was performed, the alloy being held for 32 hours at a temperature of 730° C. and cooled in air.

After the above heat-treating operations the alloy proposed herein had the following properties:

| | |
|---|---|
| Tensile strength | $\sigma_\delta$ = 135–140 kg/mm² |
| Yield strength | $\sigma_{0,2}$ = 85–90 kg/mm² |
| Ductility | $\delta$ = 20% |

It also possessed high order of high-temperature strength:

| | |
|---|---|
| at 650° C. $\sigma_{400}$ = 83 kg/mm²; | at 700° C. $\sigma_{400}$ = 65 kg/mm²; |
| at 750° C. $\sigma_{400}$ = 52 kg/mm²; | at 800° C. $\sigma_{100}$ = 38 kg/mm² and |
| at 850° C. $\sigma_{100}$ = 30 kg/mm². | |

EXAMPLE NO. 2

A nickel-base alloy of the following composition (weight percent) was taken: 0.07 carbon; 15 chromium; 3.0 titanium; 3.0 aluminum; 4.0 niobium; 12 cobalt; 6 molybdenum; 0.1 lanthanum; 0.01 boron; 0.01 cerium and the balance-nickel.

The above alloy was subject to heat treatment which involved hardening at a temperature of 1150° C. for 8 hours with subsequent cooling in still air. This was followed by the second hardening at a temperature of 1050° C. for 4 hours and cooling in air. After that ageing was effected by holding the alloy at a temperature of 850° C. for 8 hours with subsequent cooling in air.

On completion of the said heat treatment the alloy proposed herein had the following properties:

| | |
|---|---|
| Tensile strength | $\sigma_\delta$ = 160 kg/mm²; |
| Yield strength | $\sigma_{0,2}$ = 100 kg/mm²; |
| Ductility | $\delta$ = 20% and the high level |

of the high-temperature strength:

| | |
|---|---|
| at 650° C. $\sigma_{100}$ = 85 kg/mm²; | at 700° C. $\sigma_{100}$ = 68 kg/mm²; |
| at 750° C. $\sigma_{100}$ = 55 kg/mm²; | at 800° C. $\sigma_{100}$ 42 kg/mm²; |
| at 850° C. $\sigma_{100}$ = 30–32 kg/mm². | |

The nickel-base alloy of the composition proposed hereinbefore has a high order of the high-temperature strength and technological ductility, adequate deformability and high mechanical properties by which virtue it can find wide application for the production of turbine disks and other components operating at a temperature of 800° C. and over, the stresses ranging from 40 to 42 kg/mm² and with the service life of 100 hr.

An important merit of the alloy is its full insensitivity to the effect of stress concentrator owing to its high ductility, thermal stability and relaxation resistance.

The proposed alloy is superior in the level of the high-temperature strength to the now-existing alloys, both producted in the Soviet Union and abroad. The contents of high-priced and scarce elements in the alloy proposed herein is decreased by 1.5–2 times, and it does not contain such a scarce alloying element as tungsten is.

The proposed nickel-base alloy is adaptable for the manufacture of turbine and compressor disks for turbojet and turboprop engines operating at higher temperatures and stresses than the now-existing flying vehicles.

What we claim is:

1. A nickel-base alloy consisting of the following components in weight percent: 0.04–0.08 carbon; 13–16 chromium; 2.3–3.0 titanium; 1.8–3.0 aluminum; 2.2–6.0 niobium; 6–12 cobalt; 4–8 molybdenum; 0.001–0.1 lanthanum; 0.001–0.01 boron; 0.001–0.03 cerium and the balance-nickel.

2. An alloy according to claim 1 consisting of the following components in weight percent: 0.05 carbon; 13 chromium; 2.3 titanium; 2.3 aluminum; 2.5 niobium; 8 cobalt; 4 molybdenum; 0.01 lanthanum; 0.001 boron; 0.001 cerium and the balance nickel.

3. An alloy according to claim 1 consisting of the following components in weight percent: 0.07 carbon; 15 chromium; 3.0 titanium; 3.0 aluminum; 4.0 niobium; 12 cobalt; 6 molybdenum; 0.1 lanthanum; 0.01 boron; 0.01 cerium and the balance nickel.

* * * * *